US010344344B2

(12) United States Patent
Sebald et al.

(10) Patent No.: US 10,344,344 B2
(45) Date of Patent: Jul. 9, 2019

(54) COLD-ROLLED FLAT STEEL PRODUCT AND METHOD FOR ITS PRODUCTION

(71) Applicant: ThyssenKrupp Steel Europe AG, Duisburg (DE)

(72) Inventors: Roland Sebald, Geldern (DE); Dorothea Mattissen, Mulheim (DE); Sigrun Ebest, Oberhausen (DE); Stefan Follner, Dorsten (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 667 days.

(21) Appl. No.: 14/377,398

(22) PCT Filed: Jul. 10, 2013

(86) PCT No.: PCT/EP2013/064551

§ 371 (c)(1),
(2) Date: Aug. 7, 2014

(87) PCT Pub. No.: WO2014/009404

PCT Pub. Date: Jan. 16, 2014

(65) Prior Publication Data

US 2015/0000797 A1 Jan. 1, 2015

(30) Foreign Application Priority Data

Jul. 10, 2012 (EP) ..... 12175756

(51) Int. Cl.
*C21D 8/02* (2006.01)
*C21D 9/46* (2006.01)
(Continued)

(52) U.S. Cl.
CPC ..... *C21D 8/0263* (2013.01); *C21D 8/0226* (2013.01); *C21D 8/0236* (2013.01);
(Continued)

(58) Field of Classification Search
CPC .. C22D 2211/005; C21D 8/0236; C22C 38/38
See application file for complete search history.

(56) References Cited

U.S. PATENT DOCUMENTS 4,394,186 A * 7/1983 Furukawa ..... C21D 8/0473 148/632
4,854,976 A * 8/1989 Era ..... C21D 8/0273 148/547

(Continued)

FOREIGN PATENT DOCUMENTS

EP 2028282 A1 2/2009
EP 2182080 A1 5/2010

(Continued)

OTHER PUBLICATIONS

Woestmann et al., "Forming High-Strength Steels", SAE International Technical Paper, 2009-01-0802, 2009, doi: 10.4271/2009-01-802, 9 pages.

(Continued)

*Primary Examiner* — Matthew E Hoban
*Assistant Examiner* — Jeremy C Jones
(74) *Attorney, Agent, or Firm* — The Webb Law Firm

(57) ABSTRACT

The invention relates to a cold-rolled flat steel product which, despite high strength values, has a high level of deformability characterized by a high elongation at break and a good hole expansion ratio $\lambda_M$. For this purpose the flat steel product is produced from a steel that is composed of (in % by weight) C: 0.12-0.19%, Mn: 1.5-2.5%, Si: >0.60-1.0%, Al: ≤0.1%, Cr: 0.2-0.6%, Ti: 0.05-0.15% with the remainder being iron and unavoidable impurities caused by the production process, and which comprises a perlite- and bainite-free structure having 4-20% by vol. martensite, 2-15% by vol. residual austenite, remainder ferrite, an elongation at break A80 of at least 15%, a tensile strength Rm of at least 880 MPa, a yield strength ReL of at least 550 MPa and a hole expansion ratio $\lambda_M$ of more than 6%. The invention also relates to a method which easily enables production of a flat steel product according to the invention.

9 Claims, 1 Drawing Sheet

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/38*** | (2006.01) |

(52) U.S. Cl.

CPC ..... *C21D 8/0273* (2013.01); *C21D 8/0284* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/28* (2013.01); *C22C 38/38* (2013.01); *C21D 2211/001* (2013.01); *C21D 2211/002* (2013.01); *C21D 2211/005* (2013.01); *C21D 2211/008* (2013.01); *C21D 2211/009* (2013.01)

(56) References Cited

U.S. PATENT DOCUMENTS

| | | | | |
|---|---|---|---|---|
| 5,470,529 | A * | 11/1995 | Nomura | C21D 8/0226 148/320 |
| 6,210,496 | B1 * | 4/2001 | Takagi | C22C 38/34 148/333 |
| 6,706,419 | B2 * | 3/2004 | Yoshinaga | C21D 8/0226 148/320 |
| 7,767,036 | B2 * | 8/2010 | Kashima | C21D 6/00 148/320 |
| 2002/0197508 | A1 * | 12/2002 | Yoshinaga | C21D 8/0226 428/659 |
| 2003/0047257 | A1 * | 3/2003 | Kami | C21D 8/0273 148/651 |
| 2004/0177905 | A1 * | 9/2004 | Hasegawa | C21D 8/0273 148/601 |
| 2010/0108200 | A1 * | 5/2010 | Futamura | C21D 6/001 148/503 |

FOREIGN PATENT DOCUMENTS

| | | | | |
|---|---|---|---|---|
| EP | 2258886 | A1 | 12/2010 | |
| JP | 2012117148 | A * | 6/2012 | C21D 8/0226 |
| WO | WO-2009021898 | A1 * | 2/2009 | C22C 38/001 |

OTHER PUBLICATIONS

Rocha et al., "Microstructural Evolution at the Initial Stages of Continuous Annealing of Cold Rolled Dual-Phase Steel", Materials Science and Engineering, Aug. 30, 2004, pp. 296-304, vol. 391.

* cited by examiner

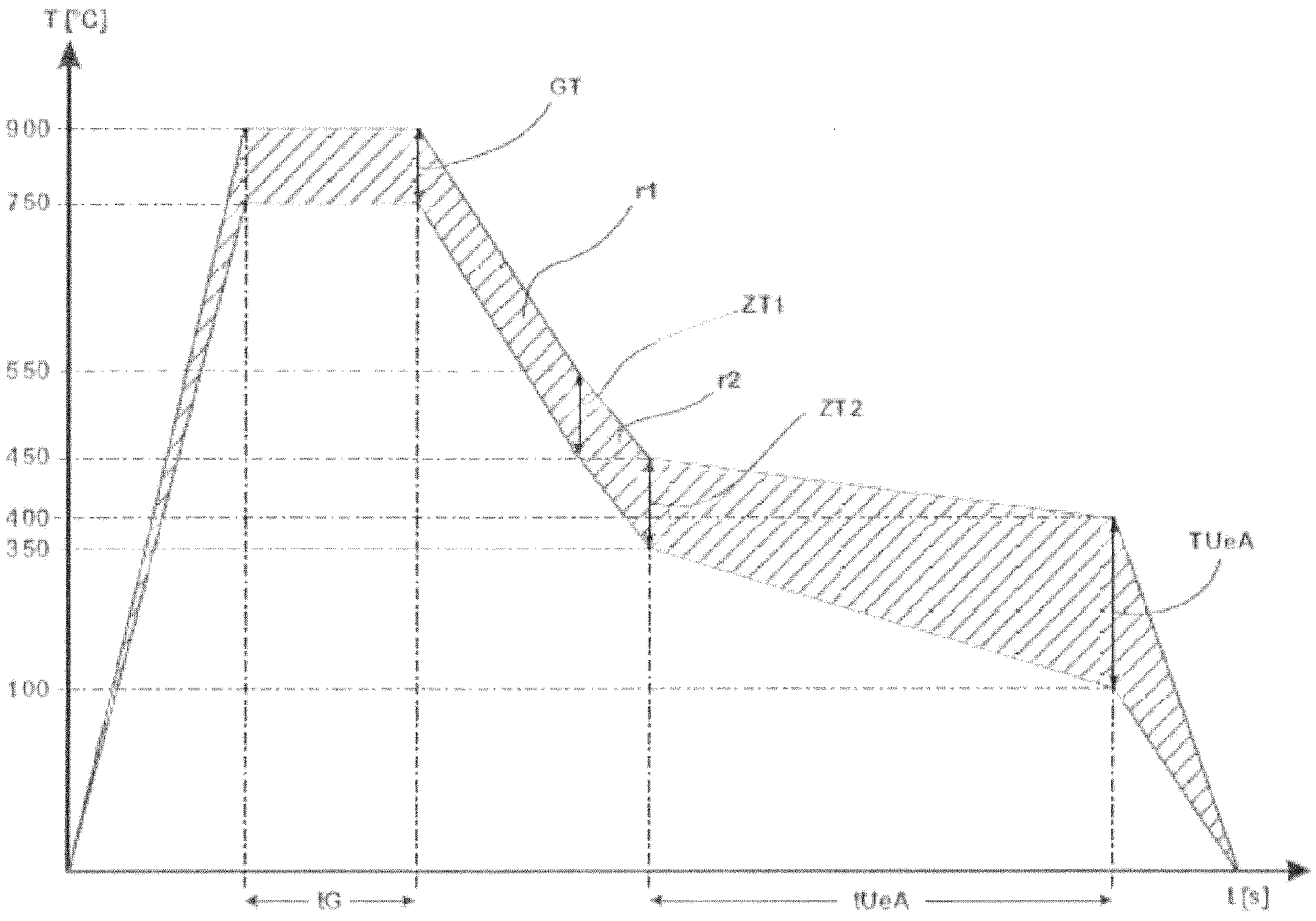
T [°C]
900
750
550
450
400
350
100
GT
r1
ZT1
r2
ZT2
TUeA
t [s]
tG
tUeA

COLD-ROLLED FLAT STEEL PRODUCT AND METHOD FOR ITS PRODUCTION

CROSS-REFERENCE TO RELATED APPLICATIONS

This application is the United States national phase of International Application No. PCT/EP2013/064551 filed Jul. 10, 2013, and claims priority to European Patent Application No. 12175756.1 filed Jul. 10, 2012, the disclosures of which are hereby incorporated in their entirety by reference.

The invention relates to a cold-rolled flat steel product and to a method for its production.

Where "flat steel products" are mentioned here, steel strips and sheets or blanks obtained therefrom are meant thereby.

The development of weight-reduced vehicles, which satisfy modern requirements for minimised fuel consumption accompanied by optimum passenger safety, a high level of comfort and loading capacity, has been driven by the automotive industry in recent years.

Flat steel products in particular are basically optimally suitable for automotive body construction due to their mechanical properties, and in particular their high strength and good deformability and their controlled production and processing. The metal sheet thicknesses of the flat steel products used in a car have to be reduced, however, for the desired reduction in weight. For this purpose steels with higher strengths have been developed which also have good formability and are therefore particularly suitable for a lightweight construction in automotive engineering. These include modern multi-phase steels, such as complex phase steels, dual-phase steels and TRIP steels.

A dual-phase steel is known from EP 2 028 282 A1 which, in addition to a strength of at least 950 MPa and good deformability, also has a surface quality which, by using a simple production method, allows the flat product produced from this steel to be deformed in the uncoated state, or when provided with a coating which protects against corrosion, into a component with a complex shape, such as part of a car body. According to this prior art this is achieved in that the known dual-phase steel is composed of 20-70% martensite, up to 8% residual austenite, with the remainder being ferrite and/or bainite. The known steel comprises (in % by weight): C: 0.10-0.20%, Si: 0.10-0.60%, Mn: 1.50-2.50%, Cr: 0.20-0.80%, Ti: 0.02-0.08%, B: <0.0020%, Mo: <0.25%, Al: <0.10%, P: <0.2%, S: <0.01%, N: <0.012%, with the remainder being iron and unavoidable impurities. A flat steel product produced from such a steel can be used as a hot strip or cold strip. In the known steel Si is used to increase the strength by hardening the ferrite or bainite. To be able to use this effect a minimum amount of Si of 0.10% by weight is provided. At the same time the amount of Si is restricted to 0.6% by weight, however, wherein lower upper limits for the amount of Si have proven to be particularly preferred in order to minimise the risk of grain boundary oxidation.

In addition to the suitability for large-volume or large-area deformation to form a component, behaviour in the case of locally limited deformation also plays an important part in particular with flat steel products that are to be used for car body construction. Deformations of this kind occur if openings, flanges, stamped slots, protuberances or the like are formed in a flat steel product or a metal blank formed therefrom or a component formed from such a metal blank.

The, according to Marciniak, so-called hole expansion ratio $\lambda_M$ has been proposed as a measure of the behaviour of a flat material in the case of such a deformation in Woestmann, S., Kohler, T., Schott, M., "Forming High-Strength Steels", SAE Technical Paper 2009-01-0802, 2009, doi: 10.4271/2009-01-0802, by means of which the sensitivity of a material to edge cracking during deformations of the type mentioned above may be evaluated. The investigation according to Marciniak provides that a punched hole with a diameter of 20 mm ($d_0$) is introduced centrally into a rectangular metal blank using a punch, the hole being 220 mm long transversely to the rolling direction and 200 mm long in the rolling direction. The blade clearance is 8% to 14% of the metal sheet thickness. For testing, the metal blank is placed in the testing tool in such a way that the level of cutting of the hole is located on the bottom. The hold-down force is a maximum of 400 kN. A round punch with a diameter of 100 mm is then moved towards the sample beneath the tool and the metal blank is arched upwards until the edge of the hole collapses. The maximum hole diameter $d_M$ achieved when a first crack appears in the edge of the hole is recorded and the hole expansion ratio $\lambda_m$ determined as the ratio $d_0/d_M$, given in %.

Against the background of the prior art mentioned above, the object of the invention was to disclose a flat steel product which can be produced using simple means and which, despite high strength values, has optimum deformability which is characterised by a high elongation at break and a good hole expansion ratio $\lambda_M$. A method shall also be disclosed which easily enables production of a flat steel product of this kind.

In relation to the flat steel product, this object is achieved according to the invention in that a flat steel product of this kind has the features disclosed in claim 1.

In relation to the method, the solution according to the invention to the object mentioned above consists in that the steps disclosed in claim 4 are passed through during production of a cold-rolled flat steel product according to the invention.

A flat steel product according to the invention is accordingly produced from a steel that is composed of (in % by weight)

C: 0.12-0.19%,
Mn: 1.5-2.5%,
Si: >0.60-1.0%
Al: ≤0.1%,
Cr: 0.2-0.6%,
Ti: 0.05-0.15% and the remainder is iron and unavoidable impurities caused by the production process. The relevant unavoidable impurities include (in % by weight) up to 0.1% Mo, up to 0.03% Nb, up to 0.03% V, up to 0.0008% B, up to 0.01% S, up to 0.1% P, up to 0.01% N.

At the same time, in the cold-rolled state a flat steel product according to the invention comprises

- a perlite- and bainite-free structure having 4-20% by vol., in particular at least 6% by vol., martensite, 2-15% by vol. residual austenite, remainder ferrite,
- an elongation at break A80 of at least 15%,
- a tensile strength Rm of at least 880 MPa,
- a yield strength ReL of at least 550 MPa and
- a hole expansion ratio $\lambda_M$ of more than 6%.

The structure of the flat steel product according to the invention is characterised in that it comprises 2-15% by vol., in particular at least 5% by vol., preferably even more than 8% by vol., residual austenite. At the same time the structure of a steel according to the invention is free in the technical sense from bainite and perlite. In other words, in the cold-rolled state there are at most traces of bainite and perlite in the structure of a flat steel product according to the invention and these have no effect on the technical properties of the flat steel product according to the invention. The presence of effective fractions of bainite or perlite in the structure of a flat steel product according to the invention would impair its elongation at break and therewith its deformability, in particular the aspired for good hole expansion ratio. The amounts of residual austenite specified according to the invention mean that the required elongation at break of at least 15%, which a flat steel product according to the invention has, is achieved, however.

A cold-rolled flat steel product according to the invention has clear differences compared to conventional modern multi-phase steels. As a rule complex phase steels have a higher yield point ratio in the case of a lower "quality", calculated as the product of tensile strength Rm and elongation at break A80, compared to a flat steel product according to the invention. This can be attributed to the relatively high yield point and the lower elongation of the known steels.

The deformation behaviour of the flat steel product according to the invention resembles that of a dual-phase steel. One major difference, however, can be found in the structures. Whereas a flat steel product according to the invention has an amount of residual austenite of up to 15%, dual-phase steels do not have a residual austenite content or have only a very low one.

In contrast to the flat steel product according to the invention, TRIP steels have significantly higher elongations at break. As a rule this results in qualities (Rm*A80) of 20,000 MPa*% and above. However, TRIP steels have to be alloyed with increased amounts of carbon, silicon and/or aluminium to achieve firstly what is referred to as the TRIP effect due to adequate stabilisation of the residual austenite and secondly, the appropriate strength. An alloying concept of this kind leads to weldability which is much poorer than that of a flat steel product according to the invention, however, in which high strengths can be achieved on the one hand and good weldability on the other due to adjustment of the amounts of alloy element that are optimised in particular with respect to the amount of Si.

In a flat steel product according to the invention the hole expansion ratio $\lambda_M$ determined according to Marciniak is at least 6%, wherein hole expansion ratios $\lambda_M$ of 7% and above are regularly achieved.

With a minimum tensile strength Rm of 880 MPa a flat steel product according to the invention has a high elongation at break of at least 15% and therewith a quality (Rm*A80) which is regularly at least 14,000 MPa*%. The tensile strengths Rm of flat steel products according to the invention are typically in the range of 880-1,150 MPa.

The yield point of a flat steel product according to the invention is at least 550 MPa, wherein yield points of 580 MPa and above are regularly achieved. The yield points of flat steel products according to the invention typically lie in the range of 580-720 MPa. For a flat steel product according to the invention the yield point ratio (ReL/Rm) is accordingly also regularly 0.55-0.75.

The elongation at break A80 of a flat steel product according to the invention is at least 15%, wherein elongations at break A80 of up to 25% are regularly achieved.

A k value which is regularly greater than 4 results for flat steel products according to the invention from the continuous vibration test according to DIN EN 50100.

Carbon is present in a flat steel product according to the invention in amounts of 0.12-0.19% by weight to bring about an increase in strength by way of interstitial mixed crystal formation and precipitation hardening forming cementite ($Fe_3C$). The minimum amount of 0.12% by weight is necessary to achieve the desired strength. The maximum amount of 0.19% by weight should not be exceeded in order to satisfy the requirements made in practice of the weldability of flat steel products of the type according to the invention.

Manganese is present in a flat steel product according to the invention in amounts of 1.5 to 2.5% by weight. Yield point and tensile strength are increased by the addition of manganese. A tensile strength Rm of at least 880 MPa and a yield point ReL at least 550 MPa, in particular at least 580 MPa, is therefore made possible by the presence of at least 1.5% by weight manganese. There should not be more than 2.5% by weight Mn in a steel according to the invention since the risk of increases in manganese occurring intensifies with higher amounts of Mn, and these can have an adverse effect on the material behaviour.

With respect to the formation of the structure, particular importance is attached to the amount of silicon, which is present in a flat steel product according to the invention in amounts of >0.60-1.0% by weight. Since the amount of Si is greater than 0.60% by weight, the formation of perlite is suppressed, and this enables enrichment of the austenite with carbon and thereby increases the stability of the residual austenite. The residual austenite is converted during deformation into martensite thereby achieving additional hardening. With iron, silicon forms mixed crystals, moreover, by way of which the strength of the steel is increased. The positive effects of the presence of silicon in a flat steel product according to the invention may be used particularly reliably if the amount of Si is at least 0.65% by weight, in particular at least 0.7% by weight. To avoid adverse oxide scale formation during hot-rolling the amount of Si is simultaneously limited to 1.0% by weight at most, wherein oxide scale formation of this kind is limited in particular if the amount of Si is limited to 0.95% by weight at most.

The steel of which the flat steel product according to the invention is composed is aluminium-killed. Flat steel products according to the invention accordingly regularly contain more than 0.01% by weight and up to 0.1% by weight aluminium.

Chromium is present in a flat steel product according to the invention in amounts of 0.2-0.6% by weight. Chromium enhances the strength of a flat steel product according to the invention. In addition, the formation of bainite is delayed during heat processing of the steel, which occurs during the course of production of a flat steel product according to the invention, due to the presence of Cr. An amount of 0.2% by weight is necessary to achieve the required strength. The amount is limited to 0.6% by weight since tests have shown that an excessive amount of chromium has an adverse effect on the elongation and therewith on the quality (Rm*A80) of the flat steel product according to the invention.

Titanium is added to a flat steel product according to the invention as a microalloying element in amounts of 0.05-0.15% by weight. Due to the presence of Ti the steel has very fine precipitations of Ti(C, N) which contribute to an increase in strength and grain refinement. According to ASTM, the grain size of the structure is less than or equal to 15, i.e. less than or equal to 1.9 μm. To form the desired precipitations, an amount of Ti of at least 0.05% by weight is required, wherein the positive effect of Ti occurs particularly reliably if the amount of Ti in the steel is at least 0.07% by weight, in particular at least 0.09% by weight. No further improvements in the effect of Ti occur above an amount of 0.15% by weight.

By virtue of its properties a flat steel product according to the invention is suitable for applications in which relatively high degrees of deformation are necessary in combination with high strength values. Typical examples of these uses are crash-relevant components, such as longitudinal chassis beams and also chassis components that are permanently loaded during operation.

The method according to the invention for producing a cold-rolled flat steel product according to the invention comprises the following steps:

a steel melt, which is composed (in % by weight) of C: 0.12-0.19%, Mn: 1.5-2.5%, Si: >0.60-1.0%, Al: ≤0.1%, Cr: 0.2-0.6%, Ti: 0.05-0.15% with the remainder being iron and unavoidable impurities caused by the production process, is cast to form a primary product which is a slab or thin slab.

The primary product is heated through at an austenitization temperature of 1,100-1,300° C., wherein this heating-through can include heating that starts from a lower temperature or can be carried out by holding the temperature of the respective slab or thin slab by using the heat present in it after its production. Heating-through is carried out whilst taking account of the geometry of the primary product and the capacity of the available heating apparatus in such a way that the structure of the primary product is completely austenitic at the end of this heating process.

The primary product heated through at the austenitization temperature in this way is then hot-rolled to form a hot strip whose thickness is typically 1.8-4.7 mm. Temperature control in the hot-rolling mill comprising a plurality of, as a rule five to seven, rolling stands is chosen such that no recrystallisation occurs in the first two stands of the hot-rolling mill. The invention provides a hot-rolling end temperature of 850-960° C. for this purpose.

The hot strip issuing from the last stand of the hot-rolling mill is then cooled using air, water or air and water combined to a coiling temperature of 500-650° C. and coiled at this temperature. With a coiling temperature below 500° C. the deformation resistance would be too high in the subsequent cold-rolling process. With a coiling temperature above 650° C. there is the risk that grain boundary oxidation, which is damaging to deformability, will occur.

To improve its surface quality the hot strip may optionally be pickled if the need arises as a result of quality requirements.

The hot strip obtained is now cold-rolled to form a cold-rolled flat steel product which is typically 0.6-2.5 mm thick. The degree of cold rolling achieved during the cold-rolling process is at least 30% for recrystallisation to even be possible. In order not to let the rolling forces increase excessively the degree of cold rolling should not exceed 75%.

The cold-rolled flat steel product is then subjected to continuous annealing. The flat steel product is firstly heated to an annealing temperature of 750-900° C. and held at this annealing temperature for at least 80 s, in particular for 80-300 s. The minimum annealing temperature of 750° C. and a holding period of at least 80 s are necessary for sufficient austenitization to be achieved. The formation of austenite would be excessively promoted with annealing temperatures of more than 900° C. This would lead to displacement of portions of the structure in the end product, as a result of which the requisite strength of 880 MPa would no longer be ensured.

After annealing, the flat steel product is cooled in two stages.

In the first stage of the cooling process the flat steel product is cooled at a cooling rate of 8-100 K/s to an intermediate temperature of 450-550° C. The cooling rate of at least 8 K/s is required here to avoid the formation of perlite and bainite and yet still allow a sufficient amount of ferrite to be produced. The first enrichment of the austenite with carbon occurs in the temperature range of 450° C. to 550° C., moreover.

In the second stage of the cooling process the flat steel product is then cooled from the intermediate temperature at a cooling rate of at least 2 K/s to 350-450° C. Some of the martensite content of a maximum of 20% is achieved hereby, ensuring the 880 MPa minimum tensile strength Rm of a flat steel product according to the invention.

Once the end temperature of the two-stage cooling process has been achieved the flat steel product is averaged. The end temperature after an overageing period of 210-710 s is 100-400° C. As a result of diffusion processes in the strip as it passes through this overageing treatment the residual austenite is completely or partially stabilised to increase the elongation of the flat steel product for deformations subsequently undertaken on the flat steel product. The transformation of stabilised residual austenite into martensite during deformation processes increases the tensile strength, moreover.

In the final step of heat treatment carried out on the cold-rolled flat steel product the latter is cooled to room temperature. Additional martensite can develop from the unstabilised residual austenite, and this can increase the strength of the flat steel product still further.

The strip is then temper rolled at a level of temper rolling of 0.2% to 2.0%. A level of temper rolling of 0.2% is required in order to adjust the flatness and the surface quality. Levels of temper rolling of 2% should not be exceeded as otherwise the elongation at break is excessively reduced.

The flat steel product can finally optionally be provided with a metallic protective layer, ensuring by way of example corrosion protection sufficient for the respective intended purpose.

Cooling in the first stage of the two-stage cooling process can be performed using any suitable medium that ensures a sufficient cooling rate. Cooling apparatuses which are available in practice are used for this purpose. Cooling can therefore take place in moving air. It is also conceivable, however, to perform cooling with the aid of water which is sprayed onto the flat steel product.

According to a practice-oriented embodiment of the invention cooling in the second stage of the two-stage cooling process can occur in that the flat steel product is cooled by way of contact with the cooled rollers. Alternatively or additionally, the flat steel product can be cooled in the second stage of the two-stage cooling process by way of a moving flow of air.

The overageing treatment can take place by way of example in that during the overageing treatment the flat steel product passes through a space screened from the environment. The temperature of the flat steel product is adjusted to 100-400° C. in this connection. This adjustment of the temperature can be carried out as heating, cooling or holding of the temperature, starting from the temperature at which the flat steel product commences the overageing treatment.

The flat steel product can be coated particularly effectively with the metallic protective layer electrolytically.

The invention will be explained in more detail below with reference to embodiments.

The FIGURE shows a graph illustrating the ranges of the temperature profile over time that are typical for annealing according to the invention.

Seven steel melts 1-7, whose compositions are given in Table 1a, were cast to form slabs, wherein steel melts 1-5 are according to the invention and melts 6 and 7 are not according to the invention owing to their Si and Cr contents which lie outside of the specifications according to the invention.

The slabs were then heated through at an austenitization temperature of 1,100-1,300° C., so the slabs had a completely austenitic structure on entering into the subsequent hot-rolling mill.

The slabs were then been hot-rolled at the hot-rolling end temperatures WET given in Table 1b to form a hot strip with a thickness dKW of 1.8-4.6 mm, and then cooled in air to the respective coiling temperature HT, also given in Table 1b, and were coiled at the coiling temperature HT reached in each case. Pickling then optionally occurred in order to remove oxide scale present on the hot strip before cold-rolling and thus enable optimum surface characteristics during subsequent cold-rolling.

The cold-rolling of the respective hot strip which is then carried out to form a cold-rolled flat steel product with a thickness dKW occurred in each case with the levels of cold rolling KWG which are also given in Table 1b.

Samples of the cold-rolled flat steel product obtained in this way were then subjected to various heat treatments A-J in which they were each heated in a pass to an annealing temperature GT, then held at the annealing temperature GT for an annealing period tG, then brought in a first cooling stage and at a first cooling rate r1 to a first target temperature ZT1 and immediately thereafter in a second cooling stage and at a second cooling rate r2 to a second target temperature ZT2.

After the second cooling stage the samples of the cold-rolled flat steel products obtained in each case were subjected over an overageing period of a duration tUeA of 250-710 s and at an overageing temperature TUeA of 400-100° C. at the end of the treatment to an overageing treatment in a space sealed off from the environment. The parameters GT, tG, r1, ZT1, r2, ZT2 and tUeA respectively adjusted during the heat treatments A-J are listed in Table 2.

After cooling to room temperature RT the flat steel product samples were temper rolled with a level of temper rolling of D°, as given in Table 1b.

The properties of the flat steel product samples obtained in this way are summarised in Table 3.

It has been found that with respect to their tensile strength Rm or their yield point ReL the flat steel product samples produced from the steel melts 6 and 7 not composed according to the invention do not attain the lower limits specified according to the invention of 880 MPa and 550 MPa respectively, and in particular 580 MPa, even if they are subjected to a heat treatment which is carried out in accordance with the invention. By contrast, the flat steel product samples composed and heat-treated according to the invention regularly exceed these limit values.

TABLE 1a

| Steel | C | Mn | Si | Al | Cr | Ti | P | N | S |
|---|---|---|---|---|---|---|---|---|---|
| 1 | 0.17 | 1.9 | 0.72 | 0.04 | 0.37 | 0.114 | 0.012 | 0.0048 | 0.001 |
| 2 | 0.13 | 2.3 | 0.65 | 0.06 | 0.23 | 0.07 | 0.007 | 0.009 | 0.007 |
| 3 | 0.16 | 1.7 | 0.75 | 0.03 | 0.57 | 0.108 | 0.013 | 0.007 | 0.006 |
| 4 | 0.18 | 2.1 | 0.94 | 0.02 | 0.34 | 0.143 | 0.009 | 0.007 | 0.009 |
| 5 | 0.14 | 1.5 | 0.83 | 0.08 | 0.48 | 0.135 | 0.018 | 0.006 | 0.002 |
| 6 | 0.15 | 1.8 | 0.53 | 0.05 | 0.43 | 0.15 | 0.014 | 0.003 | 0.003 |
| 7 | 0.14 | 2.4 | 0.73 | 0.06 | 0.05 | 0.09 | 0.009 | 0.004 | 0.005 |

Stated contents in % by weight

Remainder iron and unavoidable impurities

TABLE 1b

| Steel | WET [° C.] | HT [° C.] | dW [mm] | KWG [%] | dKB [mm] | D° [%] | According to the invention? |
|---|---|---|---|---|---|---|---|
| 1 | 900 | 530 | 2.0 | 50 | 1.0 | 0.51 | YES |
| 2 | 910 | 560 | 2.0 | 45 | 1.1 | 0.69 | YES |
| 3 | 870 | 510 | 2.0 | 55 | 0.9 | 0.30 | YES |
| 4 | 950 | 635 | 4.6 | 50 | 2.4 | 1.50 | YES |
| 5 | 935 | 545 | 1.8 | 60 | 0.7 | 0.25 | YES |
| 6 | 910 | 530 | 2.4 | 50 | 1.2 | 0.96 | NO |
| 7 | 910 | 530 | 3.4 | 50 | 1.7 | 0.78 | NO |

TABLE 2

| Heat treatment | GT [° C.] | tG [s] | r1 {K/s] | ZT1 [° C.] | r2 [K/s] | ZT2 [° C.] | TUeA [° C.] | tUeA [s] |
|---|---|---|---|---|---|---|---|---|
| A | 750 | 150 | 9.3 | 500 | 4.3 | 400 | 260 | 440 |
| B | 810 | 150 | 11.6 | 500 | 4.3 | 400 | 280 | 440 |
| C | 840 | 150 | 13 | 500 | 4.3 | 400 | 290 | 440 |
| D | 900 | 150 | 15 | 500 | 4.3 | 400 | 270 | 440 |
| E | 810 | 200 | 8.4 | 500 | 3.1 | 400 | 150 | 600 |
| F | 810 | 90 | 18.5 | 500 | 6.9 | 400 | 350 | 250 |
| G | 810 | 150 | 13.4 | 450 | 4.3 | 350 | 300 | 440 |
| H | 810 | 150 | 9.7 | 550 | 4.3 | 450 | 320 | 500 |
| I | 810 | 150 | 14.8 | 500 | 4.3 | 350 | 350 | 440 |
| J | 810 | 150 | 17.9 | 500 | 4.3 | 350 | 400 | 440 |

TABLE 3

| Steel | Heat treatment | ReL [MPa] | Rm [MPa] | A80 [%] | Structural portions [%] Ferrite | Residual austenite | Martensite | Rm * A [MPa * %] | ReL/Rm | Wöhler curve gradient | Hole expansion Λ [%] | According to the invention? |
|---|---|---|---|---|---|---|---|---|---|---|---|---|
| 1 | A | 670 | 1123 | 15.1 | 75 | 5 | 20 | 16957 | 0.60 | 7.5 | 11.9 | YES |
| 1 | B | 660 | 1010 | 15.8 | 76 | 5 | 19 | 15958 | 0.65 | 8.9 | 12.5 | YES |
| 1 | C | 642 | 945 | 16.8 | 80 | 7 | 13 | 15876 | 0.68 | 12.4 | 13.8 | YES |
| 2 | E | 581 | 891 | 18.9 | 77 | 10 | 13 | 16840 | 0.65 | 11.5 | 7.4 | YES |
| 2 | F | 591 | 887 | 16.8 | 80 | 9 | 11 | 14902 | 0.67 | 13.1 | 7.8 | YES |
| 2 | G | 602 | 901 | 19.2 | 78 | 12 | 10 | 17299 | 0.67 | 5.9 | 7.9 | YES |
| 3 | B | 651 | 922 | 16.2 | 80 | 11 | 9 | 14936 | 0.71 | 10.6 | 12.8 | YES |
| 3 | C | 629 | 892 | 17.1 | 79 | 13 | 8 | 15253 | 0.71 | 7.1 | 13.9 | YES |

TABLE 3-continued

| Steel | Heat treatment | ReL [MPa] | Rm [MPa] | A80 [%] | Structural portions [%] Ferrite | Residual austenite | Martensite | Rm * A [MPa * %] | ReL/Rm | Wöhler curve gradient | Hole expansion Λ [%] | According to the invention? |
|---|---|---|---|---|---|---|---|---|---|---|---|---|
| 3 | D | 591 | 882 | 19.4 | 81 | 12 | 7 | 17111 | 0.67 | 12.8 | 14 | YES |
| 4 | F | 632 | 1078 | 15.1 | 77 | 8 | 15 | 16278 | 0.59 | 13.2 | 12.3 | YES |
| 4 | G | 664 | 1023 | 17.2 | 79 | 9 | 12 | 17596 | 0.65 | 12.6 | 12.5 | YES |
| 4 | H | 667 | 1031 | 17.3 | 76 | 10 | 14 | 17836 | 0.65 | 4.6 | 12.2 | YES |
| 5 | D | 603 | 897 | 20.1 | 79 | 13 | 8 | 18030 | 0.67 | 8.3 | 13.4 | YES |
| 5 | E | 663 | 1030 | 16.2 | 77 | 10 | 13 | 16686 | 0.64 | 13.0 | 12.1 | YES |
| 5 | I | 657 | 1021 | 17.3 | 77 | 5 | 18 | 17663 | 0.64 | 9.1 | 12.3 | YES |
| 5 | J | 641 | 986 | 19.8 | 76 | 14 | 9 | 19523 | 0.65 | 7.6 | 15.4 | YES |
| 6 | C | 560 | 840 | 21.2 | 84 | 8 | 8 | 17808 | 0.67 | 11.5 | 10.3 | NO |
| 6 | D | 491 | 812 | 22 | 80 | 10 | 10 | 17864 | 0.60 | 11.9 | 12.2 | NO |
| 7 | B | 531 | 876 | 18.3 | 81 | 9 | 10 | 16031 | 0.61 | 5.8 | 5.9 | NO |
| 7 | C | 512 | 823 | 19.1 | 85 | 9 | 6 | 15719 | 0.62 | 9.9 | 5.7 | NO |

The invention claimed is:

1. Method for producing a cold-rolled flat steel product, comprising the following steps:

casting a steel melt which is composed of (in % by weight)

C: 0.13-0.19%,

Mn: 1.5-2.5%,

Si: 0.65-0.83%,

Al: ≤0.1%,

Cr: 0.2-0.6%,

Ti: 0.05-0.15% with the remainder being iron and unavoidable impurities caused by the production process, to form a primary product which is a slab or thin slab, heating through the primary product to an austenitization temperature of 1,100-1,300° C., hot rolling the heated-through primary product to form a hot strip, wherein the hot-rolling end temperature is 850-960° C., cooling the hot strip to a coiling temperature of 500-650° C., coiling the hot strip cooled to the coiling temperature, optional pickling of the hot strip, cold-rolling the hot strip to form a cold-rolled flat steel product, wherein the level of cold rolling achieved during cold rolling is at least 30%, continuous annealing of the cold-rolled flat steel product, wherein during the course of continuous annealing the flat steel product is heated to an annealing temperature of 750-900° C. and is held at this annealing temperature for 80-300 s and following the annealing process is cooled in two stages, wherein the flat steel product is cooled in the first cooling stage at a cooling rate of 8-100 K/s to an intermediate temperature of 450-550° C. and is cooled in the second cooling stage from the intermediate temperature at a cooling rate of 2-100 K/s to 350-450° C. and wherein the cooling rate of the first cooling stage is greater than the cooling rate of the second cooling stage, overageing the flat steel product for an overageing period of 210-710 s, wherein at the end of overageing the temperature is 100-400° C., cooling the flat steel product to room temperature, and temper rolling the flat steel product with a level of temper rolling of 0.2-2%, wherein, after temper-rolling, the cold-rolled flat steel product has a pearlite- and bainite-free structure having 4-20% by vol. martensite, 2-15% by vol. residual austenite, remainder ferrite, an elongation at break A80 of at least 15%, a tensile strength Rm of at least 880 MPa, a yield strength ReL of at least 550 MPa, and a hole expansion ratio $\lambda_M$ of more than 6%.

2. Method according to claim 1, wherein cooling in the first stage of the two-stage cooling process occurs in moving air.

3. Method according to claim 1, including cooling the flat steel product at least in the second stage of the two-stage cooling, by contact with the cooled rollers.

4. Method according to claim 1, including cooling in the second stage of the two-stage cooling process by a moving flow of air.

5. Method according to claim 1, wherein during the overageing treatment the flat steel product passes through a space screened from the environment and in which the temperature of the flat steel product, starting from a maximum inlet temperature of 450° C., is 100-400° C. at the end.

6. Method according to claim 1, further comprising coating of the flat steel product with a metallic protective layer after temper rolling.

7. Method according to claim 6, wherein the coating with the metallic protective layer is made electrolytically.

8. Method according to claim 1, wherein the steel melt comprises 0.72-0.83% Si.

9. Method according to claim 1, wherein the steel melt comprises 0.75-0.83% Si.

* * * * *